US011883867B2

(12) United States Patent
Umlauf

(10) Patent No.: US 11,883,867 B2
(45) Date of Patent: Jan. 30, 2024

(54) ROLL LINE

(71) Applicant: Norbert Umlauf, Hagen (DE)

(72) Inventor: Norbert Umlauf, Hagen (DE)

( * ) Notice: Subject to any disclaimer, the term of this patent is extended or adjusted under 35 U.S.C. 154(b) by 0 days.

(21) Appl. No.: 17/779,265

(22) PCT Filed: Nov. 24, 2020

(86) PCT No.: PCT/DE2020/100994
§ 371 (c)(1),
(2) Date: May 24, 2022

(87) PCT Pub. No.: WO2021/104574
PCT Pub. Date: Jun. 3, 2021

(65) Prior Publication Data

US 2022/0402007 A1 Dec. 22, 2022

(30) Foreign Application Priority Data

Nov. 25, 2019 (DE) ..... 102019131761.4

(51) Int. Cl.
*B21B 37/52* (2006.01)
*B21B 39/08* (2006.01)
*B21C 47/34* (2006.01)

(52) U.S. Cl.
CPC ..... *B21B 37/52* (2013.01); *B21B 39/08* (2013.01); *B21C 47/3458* (2013.01);
(Continued)

(58) Field of Classification Search
CPC ..... B21B 37/52; B21B 37/48; B21B 39/08; B21B 39/02; B21B 2265/02; B21B 2265/08; B21B 2275/10
See application file for complete search history.

(56) References Cited

U.S. PATENT DOCUMENTS 3,760,621 A * 9/1973 Fujii ..... B21B 37/26 72/8.9
5,778,717 A * 7/1998 Berger ..... B21B 37/68 72/8.7

(Continued)

FOREIGN PATENT DOCUMENTS

DE 19919801 A1 11/2000
DE 102011107171 A1 1/2013

(Continued)

OTHER PUBLICATIONS

International Search Report dated Mar. 10, 2021 in PCT /DE2020/100994.

(Continued)

*Primary Examiner* — Teresa M Ekiert
(74) *Attorney, Agent, or Firm* — Veros Legal Solutions, LLP

(57) ABSTRACT

The invention relates to a device for rolling, in particular for stepped rolling, of rolling stock with at least one pair of rolls and at least one linear drive arranged downstream of the pair of rolls in the rolling direction, which together with the pair of rolls can apply tensile stress to the rolling stock, and with means for detecting the tensile stress. In order to enable an improved method of flexibly rolling stock, the rolling device is characterized by means for detecting the tensile stress and by a control device for controlling the drive power of the linear drive as a function of the tensile stress detected, in order optionally to vary the tensile stress applied to the stock or to keep the tensile stress constant as the drive speeds behind the roll gap change. The invention also relates to a method of rolling the rolling stock using such a device.

19 Claims, 7 Drawing Sheets

(52) U.S. Cl.
CPC ..... *B21B 2265/04* (2013.01); *B21B 2265/08* (2013.01); *B21B 2275/04* (2013.01); *B21B 2275/10* (2013.01)

(56) References Cited

U.S. PATENT DOCUMENTS

| | | | | |
|---|---|---|---|---|
| 6,378,346 | B1 * | 4/2002 | Sudau | B21B 37/54 72/11.4 |
| 9,242,284 | B2 | 1/2016 | Umlauf | |
| 2017/0260005 | A1 * | 9/2017 | Eichner | B21C 1/30 |

FOREIGN PATENT DOCUMENTS

| | | | |
|---|---|---|---|
| EP | 3216537 | A2 | 9/2017 |
| WO | 2005035158 | A1 | 4/2005 |

OTHER PUBLICATIONS

Examination Report from Intellectual Property INDIA dated Sep. 14, 2022 from PCT Application No. DE2020100994—Nov. 24, 2020.

* cited by examiner

ROLL LINE

The present invention relates to a device for rolling, in particular for stepped rolling, of rolling stock with at least one pair of rolls and at least one linear drive arranged downstream of the pair of rolls in the rolling direction, which together with the pair of rolls can apply tensile stress to the rolling stock, and with means for detecting the tensile stress. The invention also relates to a method for rolling the rolling stock with such a device.

Devices for rolling and straightening metal strips are used in rolling, straightening and processing lines for metal strips. Metal strips are rolled and straightened for different purposes. In rolling, the strip is deformed by horizontal force and thereby rolled thinner. In straightening, the strip is straightened by tension. In stretch straightening in particular, the attempt is made to keep the section of strip to be subjected to tension as small as possible. The smaller the area of deformation, the more balanced the microstructure.

A special form of rolling is stepped rolling, also known as "flexible rolling". It is used to produce, for example, load- and weight-optimized components, especially in lightweight construction. By deliberately changing the size of the rolling gap between a pair of rolls, a metal strip is produced which has various sections of different strip thicknesses along its length. The transition sections between strip sections of different thicknesses can have different inclinations.

The publication DE 38 07 399 A1 discloses a method for controlling the gap width of the rolling gap between the work rolls of a cold rolling stand for the production of strips of metal as well as a device for carrying out the method. The control is based on the signals of the measurement of the strip speed on the inlet side and on the outlet side as well as the strip thickness on the inlet side and on the outlet side. The control is considered to be disadvantageous in that the response and control times are too long to achieve sufficiently good thickness transitions, particularly in the transition sections, or to realize short transitions at all.

In order to solve the problems arising from the response of the control system and the necessary control times until correction, EP 3 097 992 A1 describes a method in which the forces applied to the metal strip by the work rolls are kept constant or at least approximately constant irrespective of a change in the size of the roll gap. This is to be achieved in particular by controlling the strip tension forces acting on the metal strip. The strip tension is controlled by changing the rotational speeds of a decoiler device, from which the strip to be rolled is unwound, and a coiler device, onto which the rolled strip is rewound. It is considered particularly advantageous if the speed of the work rolls and/or the rotational speed of the work rolls as well as the rotational speeds of the decoiler device and/or the coiler device are controlled according to precalculated data. This is to avoid the disadvantages of control by response time and control time. This method appears to be disadvantageous in that a large number of data must first be empirically recorded before a sufficient basis is available for calculating the necessary process parameters for the speeds of the coiler and work rolls, the process parameters changing for each metal strip.

U.S. Pat. No. 9,242,284 A1 describes a process for stretching rolled metal strip in which the metal strip is stretched between two linear drives. A roll stand can also be arranged between the two linear drives, so that it is possible to combine the rolling and stretching steps.

The present invention, in contrast, is intended to solve the problem of providing a rolling device of the type mentioned at the beginning, with which it is possible to roll stock flexibly, whereby the disadvantages mentioned of previously known processes for stepped rolling do not exist or at most exist to a lesser extent.

This task is solved according to the invention with a device according to claim 1 and a method according to claim 15.

When rolling stock is referred to here and in the following, this refers in particular, but not exclusively, to rolling stock in the form of metal strip. The claimed invention is also suitable for rolling, and in particular stepped rolling, slabs into thick plates or other non-strip rolling stock.

When the term linear drive is used here and in the following, it refers to a drive for the rolling stock that transmits the drive forces to the rolling stock over a longer straight section of the drive, unlike a drive by means of rollers or rolls, where the drive forces are transmitted to the rolling stock over their curved surface. A suitable linear drive is disclosed, for example, in U.S. Pat. No. 9,242,284 B2.

It was surprisingly found that it is possible to achieve very good rolling results if the tensile stress acting on the rolling stock is measured and controlled instead of the thickness of the rolling stock. By controlling the tensile stress in the cross-section of the rolling stock, it becomes possible to directly and significantly influence the flow of the rolling stock initiated by the pressure exerted by the rolls in the roll gap, and thus the reduction in thickness that can be achieved by rolling. At the same time, the flow of the microstructure in the roll gap and thus the quality of the rolling stock can be significantly optimized. This is made possible in particular by the use of a linear drive, since sufficiently high tensile stresses can be introduced into the rolled material with a linear drive. In particular, the aim is to keep the tensile stress applied to the rolling stock by the linear drive as constant as possible, regardless of the drive speed of the linear drive. However, it can also be useful to control the tension as a function of the size of the rolling pass.

By controlling the tensile stress to be applied to the rolling stock by the at least one linear drive as a function of determined tensile stress data, it is possible to keep the tensile stress constant, in particular during the production of step-rolled sheets, in the production of which the strip speed behind the rolling rolls changes constantly due to the constantly varying change in thickness reduction. The control is preferably carried out exclusively as a function of the tensile stress determined and regulates the transport speed for the rolling stock accordingly so that the tensile stress acting on the rolling stock is maintained.

In a preferred embodiment of the invention, the control device is designed to determine and/or adjust the torque acting in the linear drive in order to determine and/or adjust the tensile stress acting on the rolling stock. For example, the torque acting in the linear drive and thus the tensile stress applied to the rolling stock can be determined from the drive speed of the linear drive and the power absorbed by the linear drive. Accordingly, the power of the linear drive can be controlled by the control device and thus the tensile stress acting on the rolling stock. In this respect, it is preferred if the control device has means for determining the power consumption and the drive speed of the linear drive and is designed to determine and/or set the tensile stress from the determined information.

Servo motors, preferably two each for the upper and lower drive of a linear drive, are particularly suitable for this purpose. They enable a highly dynamic drive. Since the linear drives allow the rolling stock to be entrained without relative movements, changes in the torques generated by the servomotors are transmitted to the rolling stock without delay. In stepped rolling, among other things, this has the advantage that the transitions between areas of different thickness of the rolling stock can be comparatively short.

Alternatively or in addition thereto, the device according to the invention has force measuring bearings in the bearing of the linear drive and/or of the pair of rolls, in particular in the bearing of the drive shafts of the linear drive, for determining the tensile stress applied to the rolling stock. Such force measuring bearings are sufficiently well known. They can be designed, for example, in such a way that a gap is provided in a bearing shell of a rolling bearing and a strain gauge is attached to both sides of the gap so that a change in the gap width due to a change in the tensile stress introduced into the rolling stock can be measured. Such force measuring bearings can, for example, preferably be used to support the drive shafts of linear drives, in which case, moreover, the drive motor or motors for driving a drive shaft supported in this way are preferably connected directly to the drive shaft without the interposition of a gearbox. With force measuring bearings, highly dynamic measurement of the tensile stress in the rolled material is possible.

In principle, it is advantageous if the means for detecting the tensile stress and/or the control system are designed to measure the stress distribution over the width of the rolling stock. In particular, if the tensile stress is measured on both longitudinal sides of the rolling stock, the tensile stress distribution over the width of the rolling stock can be determined in a sufficient manner.

In order to optimize the flow of the rolling stock in the roll gap, it is also advantageous if the control device is coupled with means for adjusting the contact pressure of the roll pair. This makes it possible to control all forces acting on the rolling stock in the roll gap.

A further preferred embodiment of the invention is characterized in that the at least one linear drive has at least one adjusting device by means of which the position of the linear drive relative to the rolling stock can be changed during operation and, in particular, can be pivoted about an axis essentially orthogonal to the drive direction of the rolling stock. By pivoting the linear drive, it is possible to change and adapt the tensile stress distribution across the width of the rolling stock. This makes it possible, for example, to compensate at an early stage for a saber forming in the rolling stock during rolling, in particular if the adjusting device is coupled to the control device and the adjusting device is actuated as a function of the tensile stress distribution measured across the width of the rolling stock. Due to the adjustability of the linear actuator(s), the device according to the invention can be used not only for rolling but also for straightening the rolling stock at the same time.

It is preferred if the linear drive can be swiveled on a curved path. It makes sense that the position of the linear drive relative to the strip can also be adjusted during rolling. Furthermore, the radius of curvature of the path itself can be variable during rolling. This can also apply to both linear drives if one linear drive is arranged upstream and one downstream of the pair of rolls in the drive direction.

For this purpose, the at least one upper and the at least one lower drive, which are typically provided in a linear drive and act on the rolling stock from above and below, respectively, are held in a frame, wherein the upper and lower drives of the linear drive can be positioned within the fixed frame relative to the frame. In this context, it is furthermore preferred if at least one first adjusting device for the upper and lower drive is provided on one side of the rolling stock, by means of which the upper and lower drive can be displaced in a direction transverse to the drive direction, and at least one second adjusting device for the upper and lower drive is provided on the opposite side of the rolling stock, by means of which the upper and lower drive can be pivoted about a substantially vertical axis. Thus, the drive direction of the linear drive is comparatively freely adjustable relative to the longitudinal direction of the rolling stock.

In particular, to enable straightening of the rolling stock, it is advantageous if the linear drive can be pivoted by an angle of at least +/−10°, preferably at least +/−20°, relative to the longitudinal direction of the rolling stock.

In order to ensure the highest possible tensile stresses, it is advantageous if the upper and lower drives of the linear drive have several contact elements arranged one behind the other in the rolling direction for contacting the rolling stock, the contact elements preferably being designed to be elastic in such a way that they contact the rolling stock reliably even if it has different thicknesses in the rolling direction.

Alternatively, at least one of the linear drives can have a non-contact eddy current drive that drives the rolling stock without contact.

Preferably, a measuring device, in particular a laser-based measuring device, is provided downstream of the pair of rolls in the rolling direction for measuring the thickness and/or the speed of the rolling stock. In addition, this measuring device can be designed or further measuring devices can be provided to determine the flatness, waviness and/or saber of the rolling stock in the drive direction behind the pair of rolls. All the measurement data determined can also be used to control the tensile stress.

In yet another embodiment according to the invention, a linear drive is provided in each case in front of and behind the pair of rolls in the rolling direction, which are suitable for jointly applying tension to the rolling stock, for example in that the linear drive arranged in front of the pair of rolls in the drive direction brakes the rolling stock, while the linear drive arranged behind pulls the rolling stock.

As can already be seen from the above, the task underlying the invention is solved with a method for rolling a rolling stock with a device according to the invention in that the rolling stock is rolled by the pair of rolls, wherein a tensile stress is applied to the rolling stock by a linear drive arranged downstream of the pair of rolls in the rolling direction in cooperation with the pair of rolls and/or a linear drive arranged upstream of the pair of rolls in the rolling direction, and wherein the tensile stress exerted on the rolling stock by the linear drive is controlled.

In a particular embodiment of the process according to the invention, the height of the roll gap is changed as a function of the control device.

It is also preferred that the direction of the tensile stress exerted by the linear drive on the rolling stock is changed in a controlled manner relative to the longitudinal direction of the rolling stock in order to straighten the rolling stock or to minimize or avoid a saber error.

With the device according to the invention, a rolling process is also possible in which the rolling stock passes through the pair of rolls alternately in opposite directions. In other words, the device according to the invention makes it possible to roll in reversing mode for at least individual sections of the rolling stock, in particular, but not exclusively, if a linear drive is provided in each case upstream and downstream of the roll gap.

With the process, it is possible and useful to control the tensile stress in such a way that it causes at least 50% of the deformation of the rolled material in the roll gap.

In the following, the invention is explained in more detail with reference to figures showing preferred embodiments of the invention.

Figure 1:
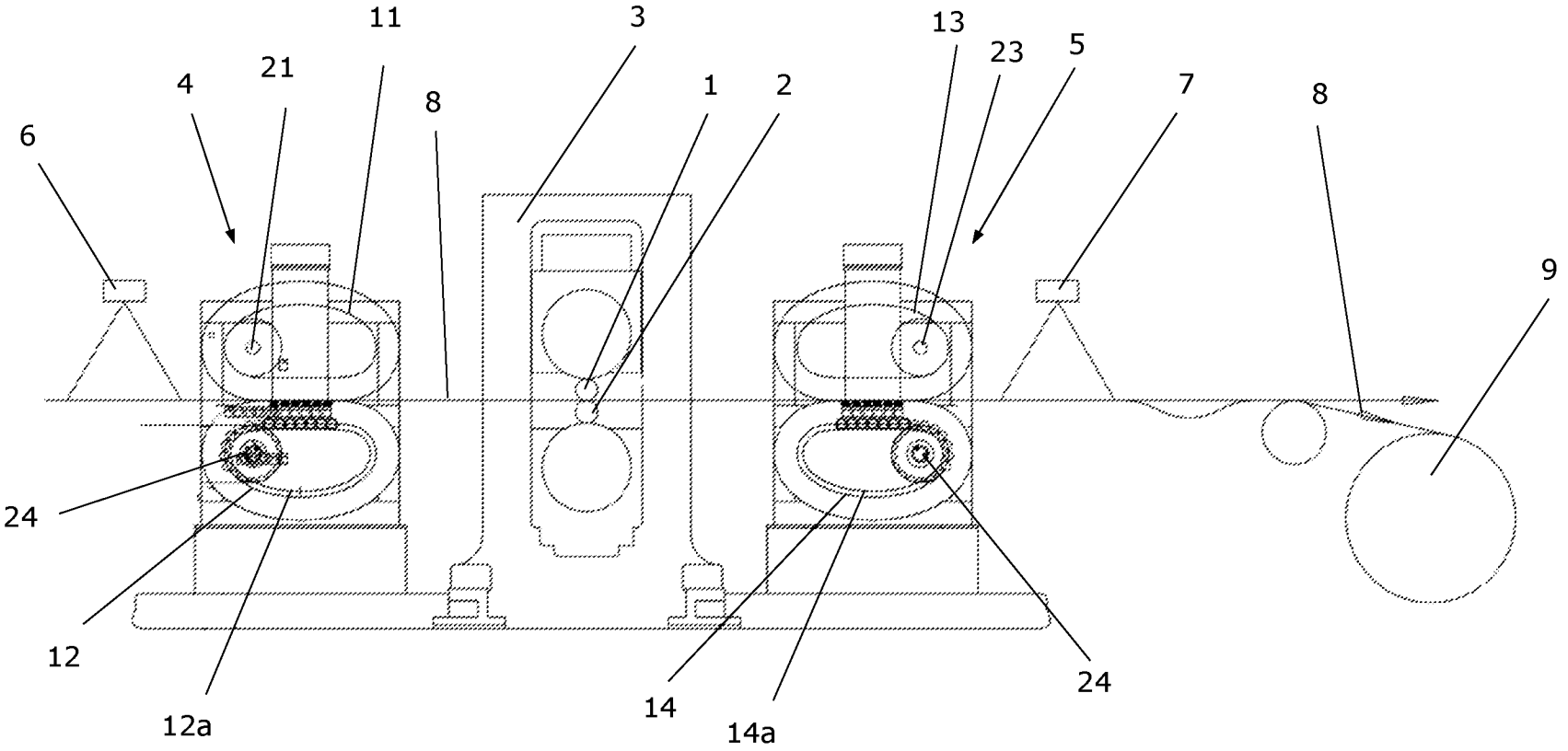
FIG. 1 shows a side view of the basic structure of a rolling line according to the invention.
Figure 2:
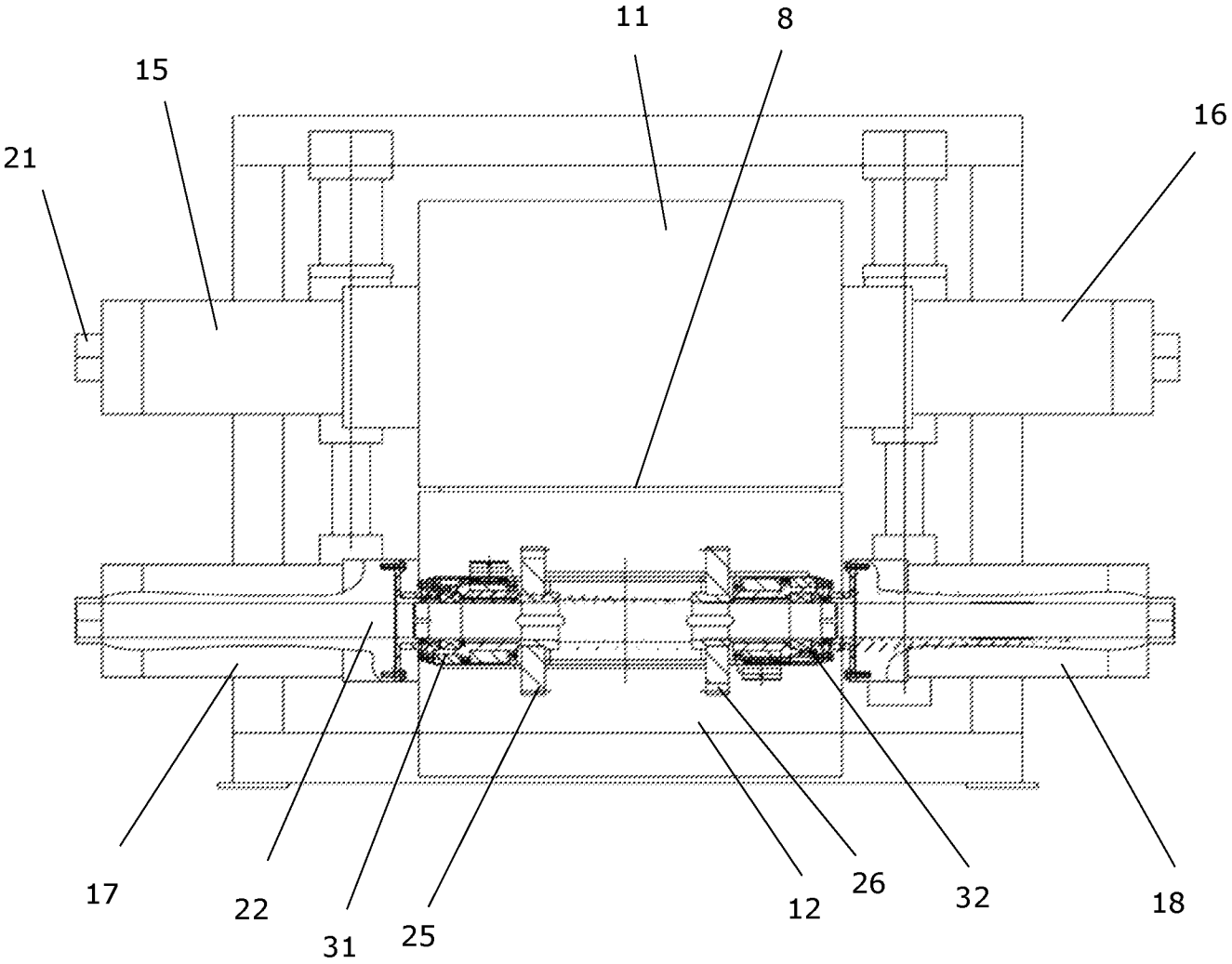
FIG. 2 shows the basic structure of the linear actuator 4 shown in FIG. 1 in a partially cutaway side view.
Figure 3A:
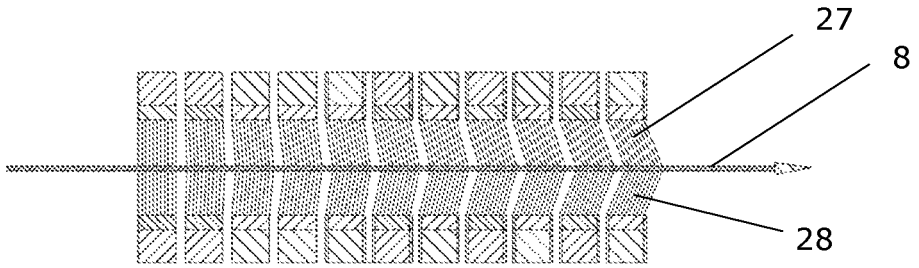
Figure 3B:
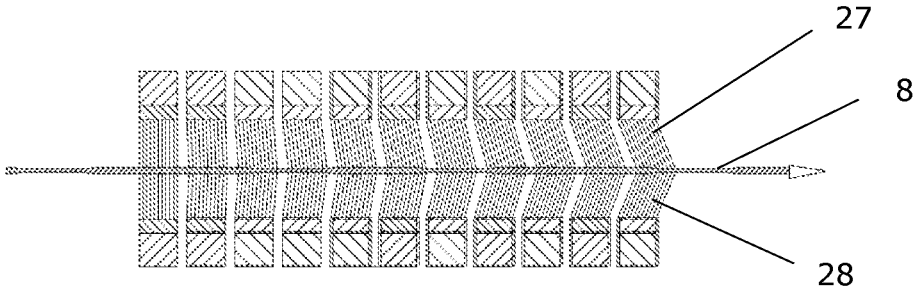
Figure 4A:
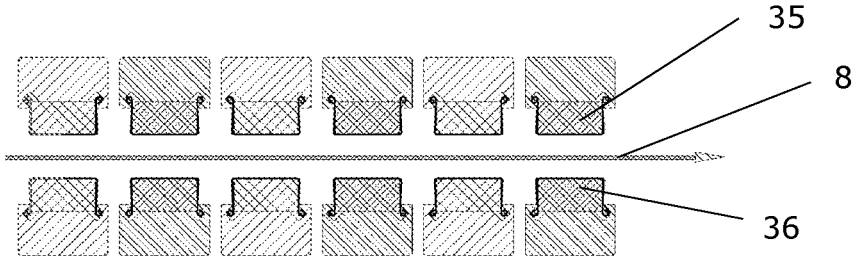
Figure 4B:
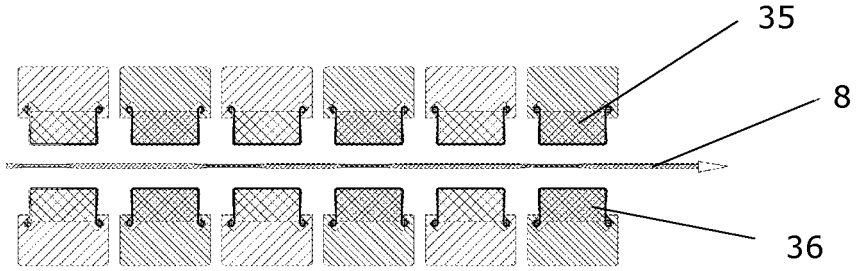
Figure 5:
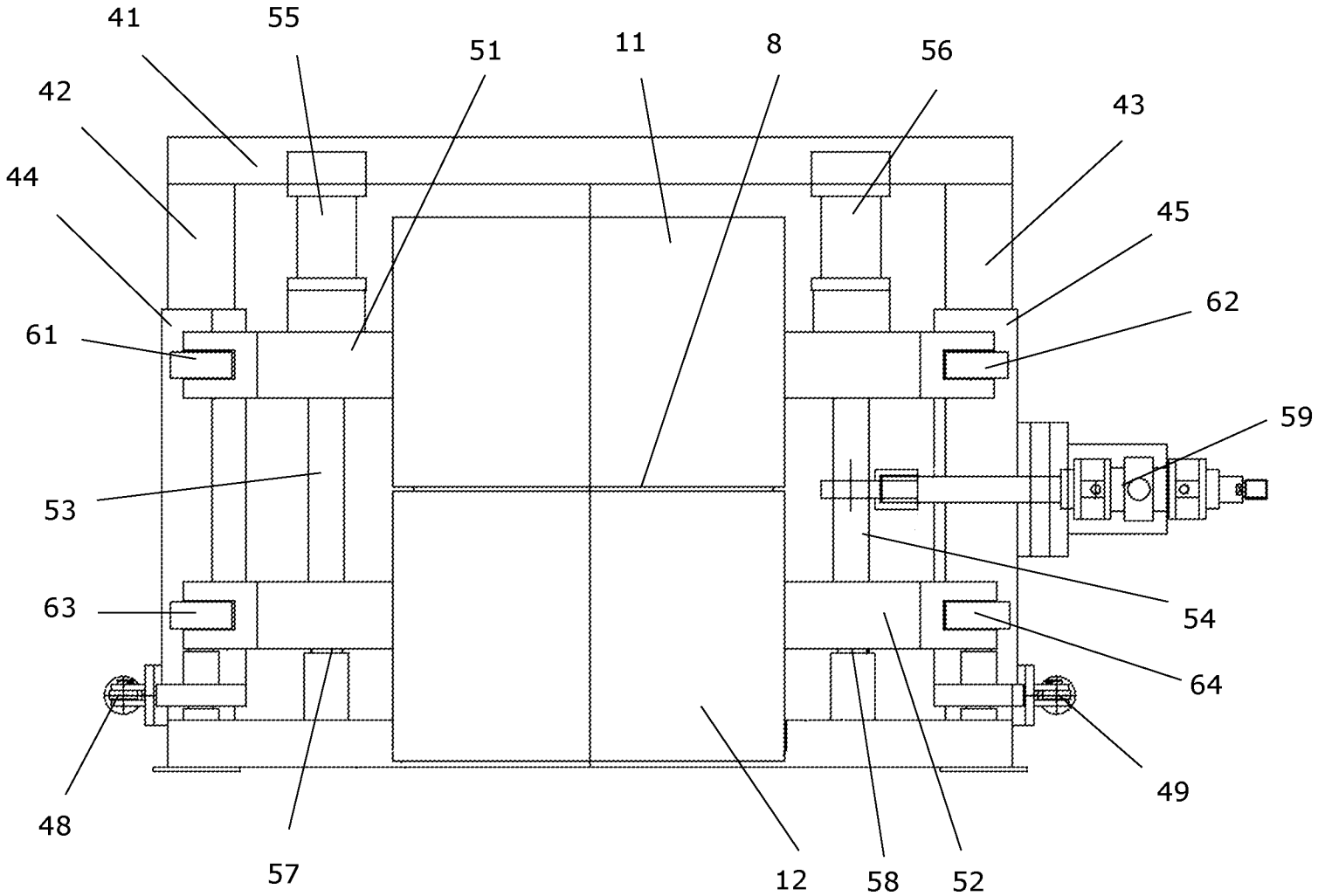
Figure 6:
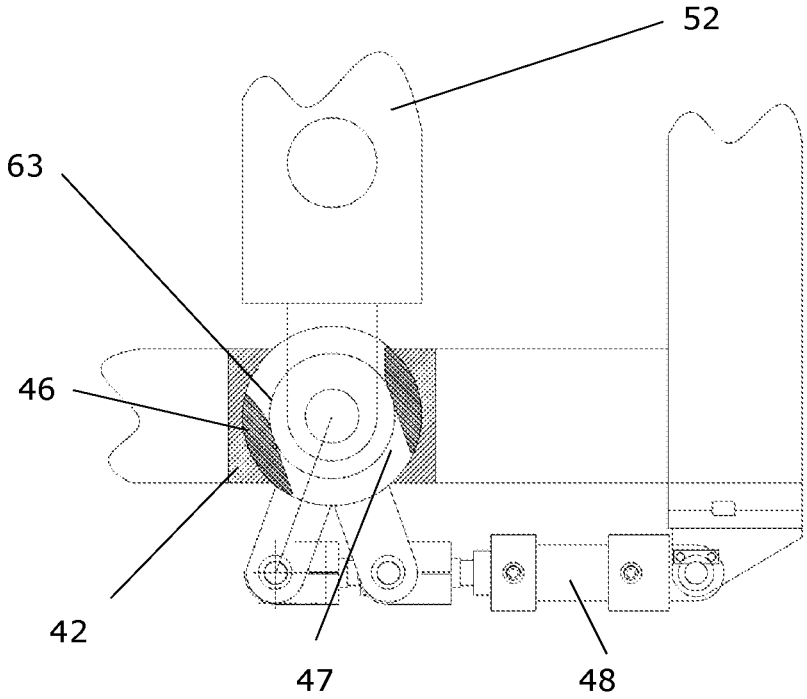
Figure 7A:
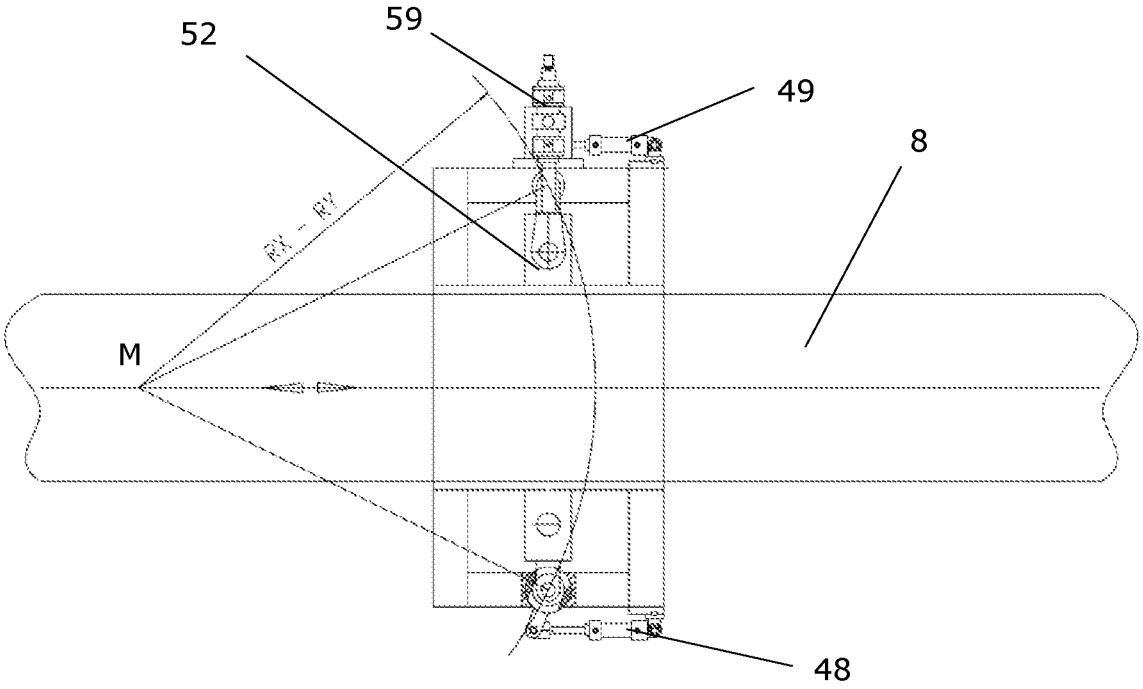
Figure 7B:
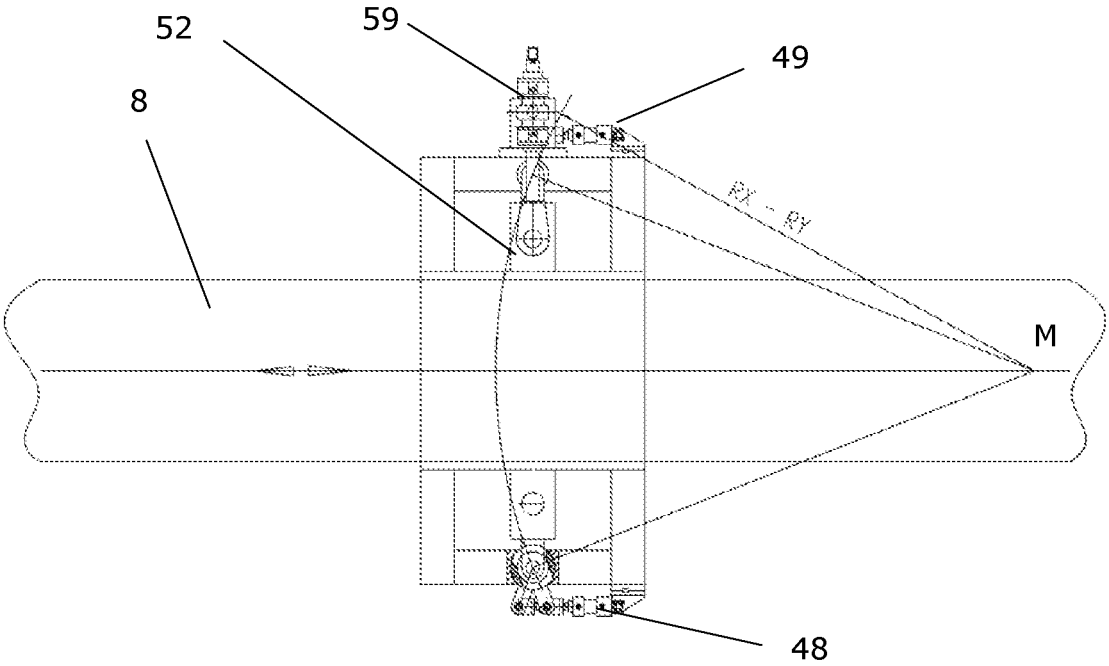
Figure 8:
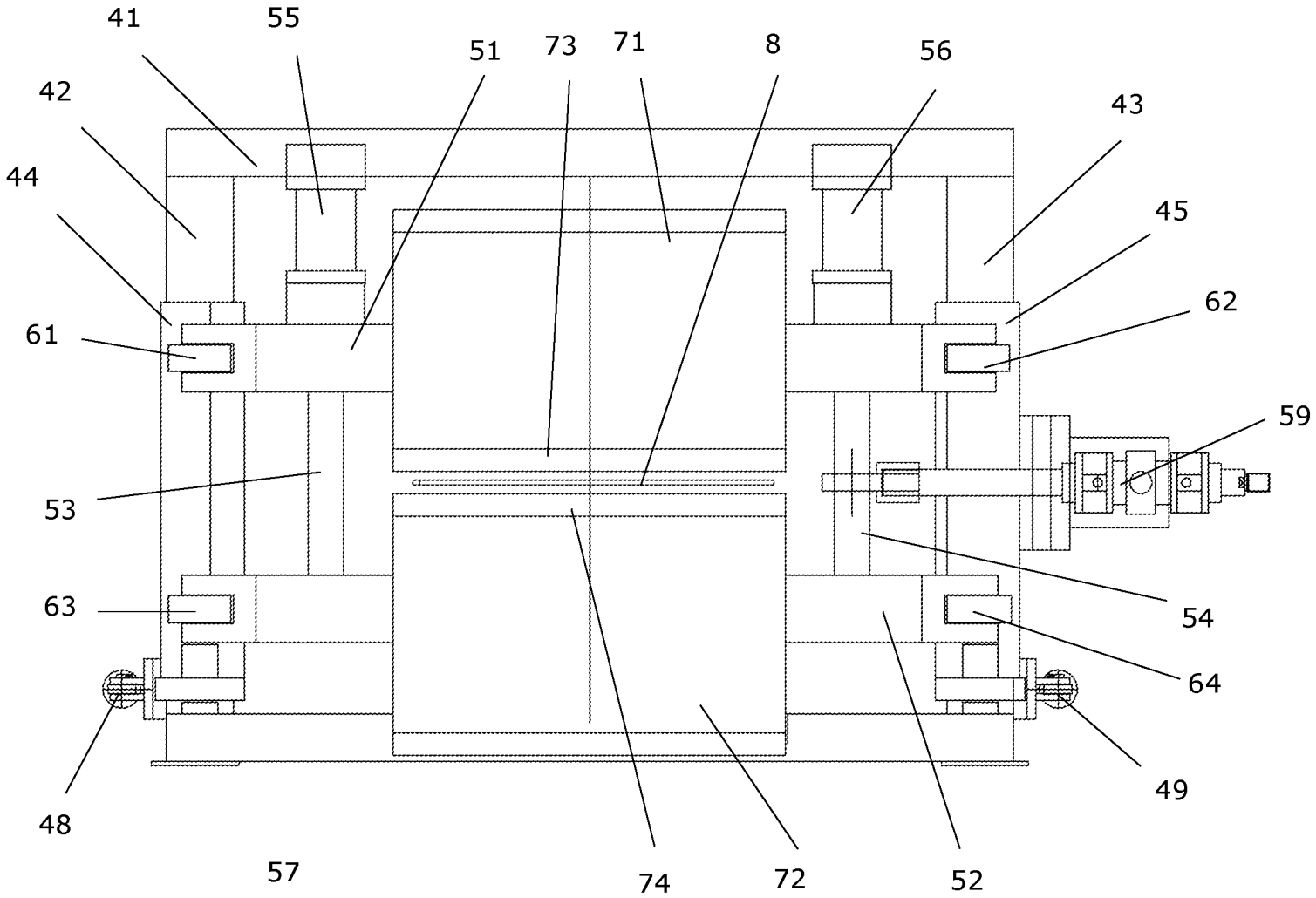

FIG. 3*a* schematically shows the behavior of elastic contact elements of the linear drive in the driving zone in front of the pair of rolls of the rolling line with a metal strip of uniform thickness;

FIG. 3*b* schematically shows the behavior of elastic contact elements of a linear drive in the driving zone behind the pair of rolls of the rolling line with a step-rolled metal strip;

FIG. 4*a* schematically shows a linear drive in the form of an eddy current drive in the driving zone in front of the pair of rolls of the rolling line with a metal strip of uniform thickness;

FIG. 4*b* schematically shows a linear drive in the form of an eddy current drive in the driving zone behind the pair of rolls of the rolling line with a step-rolled metal strip;

FIG. 5 shows the basic structure of the linear drive 4 shown in FIG. 1 in a sectional, schematized view;

FIG. 6 shows a partially cutaway top view of an actuator for the linear drive of FIGS. 2 and 5;

FIG. 7*a* shows a partially cutaway top view of the linear drive of FIGS. 2 and 5 in a first operating position;

FIG. 7*b* shows a partially cutaway top view of the linear drive of FIGS. 2 and 5 in another operating position; and FIG. 8 shows the basic design of a linear drive as in FIG. 5, but here with an eddy current drive.

FIG. 1 shows a rolling and stretching line according to the invention with a roll stand 3 comprising a pair of rolls 1 and 2 as well as a linear drive 4 arranged upstream of the roll stand 3 in the strip running direction and a linear drive 5 arranged downstream of the roll stand 3, which is particularly suitable for the stepped rolling of hot-rolled or cold-rolled metal strip. A measuring device 6 is provided upstream of the linear drive 4 in the direction of strip travel, just as a measuring device 7 is provided downstream of the linear drive in the direction of strip travel. These measuring devices 6, 7 are provided in particular to determine the strip speed, as well as the flatness, evenness, maneuverability and sway of the metal strip 8 guided through the rolling and stretching line. At the end of the line there is a coiler 9 onto which the rolled metal strip 8 is coiled.

As can be also seen in particular in FIG. 2, the linear drive 4 has an upper drive with a circulating chain 11 shown only schematically in FIG. 2 and a lower drive with a circulating chain 12. Accordingly, the linear drive 5 has an upper drive with a circulating chain 13 and a lower drive with a circulating chain 14. The circulating chains 11, 12, 13, 14 circulate in chain rails 12*a*, 14*a* and are each driven by two servo motors 15, 16, 17, 18, which are arranged on either side of a drive shaft 21, 22, 23, 24 of the respective drives and transmit the drive torque to the circulating chains 11, 12 via gear wheels 25, 26. The drive shafts 21, 22, 23, 24 are mounted on the chain rails 12*a*, 14*a*.

The metal strip 8 is guided between the upper and lower circulating chains 11, 12, 13, 14 of the linear drives 4, 5. Contact elements 27, 28 are arranged on the chain links of the circulating chains 11, 12, the contact elements being of elastic design so that they can grip a metal strip firmly even if the thickness of the metal strip changes over the length of the contact area of the linear drive 4, 5, which can be seen in particular from the illustrations in FIGS. 3*a* (illustration with evenly rolled metal strip 8) and 3*b* (illustration with step-rolled metal strip 8). Similarly, comparatively rigid contact elements can be spring-mounted, provided that the springs are designed to be sufficiently stiff for the mounting.

As an alternative to contact-based linear drives, it is also possible to use contactless linear drives, in particular eddy current-based linear drives, whose chain links are provided with magnets. Since the drive is contactless, a metal strip with a thickness that varies along its length can also be driven linearly without any problems. FIGS. 4*a* and 4*b* show how a metal strip 8 is guided between magnets or electric coils 35, 36 of the upper and lower drives of an eddy current linear drive, the metal strip 8 shown in FIG. 4*a* being rolled flat and the metal strip 8 shown in FIG. 4*b* being step-rolled.

In this embodiment, the tensile stress in the metal strip 8 is generated by a tension applied by the linear drive 5 and a counter-tension applied by the linear drive 4. The linear drives 4 and 5 are technically identical for this purpose, but are installed in the line rotated by 180° so that the motors are each located on the side of the respective linear drive 4, 5 facing away from the roll stand 3.

The tensile stress applied in the metal strip 8 is determined by means of force measuring bearings 31, 32, which, as can be seen in FIG. 2, are arranged respectively on the sides of the driving area of the linear drive 4, 5 defined by the circulating chains 11, 12.

FIG. 5 shows in particular the operation of the positioning devices for positioning the linear drive 4 shown in FIG. 2. The linear drive 4 has a fixed frame 41 with lateral posts 42, 43. As can be seen in particular from the sectional view in FIG. 6, rotary columns 44, 45 are mounted in the lateral posts 42, 43. Each of the rotary columns 44, 45 has, as can be seen in FIG. 6, an outer wall 46 open on opposite sides over a long section. In this section, the inner wall of each of the rotary columns 44, 45 is formed as a guide 47. For pivoting the rotary columns 44, 45, actuators 48, 49 are provided at their lower ends. The angular position of the rotary columns 44, 45 can be adjusted over a comparatively wide range (two possible adjustment positions are shown in FIG. 6).

The upper drive is held by an upper cross member 51 and the lower drive by a lower cross member 52. On both sides next to the circulating chains 11, 12, guide pillars 53, 54 are located on the lower cross member, on which the upper cross member 51 is mounted so that it can be moved vertically. The upper cross member 51 can be positioned vertically relative to the lower cross member 52 by means of hydraulic cylinders 55, 56, which are supported at the top of frame 41. The lower cross member 52 is supported on sliding bearings 57, 58 provided in the area of the guide pillars 53, 54 under the lower cross member 52. The guide pillar 53 and thus the entire linear drive can be adjusted transversely to the transport direction by means of an actuator with an actuator 59, the drive rod of which is connected to the guide pillar 53.

Support rolls 61, 62, 63, 64 are provided at the ends of the upper cross member 51 and the lower cross member 52 and are guided in a horizontal plane in the guides 46, 47 of the rotary columns 44, 45. The support rolls 61, 62 of the upper cross member 51 are vertically displaceable in the rotary columns 44, 45.

In combination with the actuators 48, 49, with which the position of the guides of the rotary columns 44, 45 can be adjusted, and the actuator 59 acting transversely to the transport direction, it is possible to pivot the entire linear drive on an essentially part-circular path section about a virtual center point, which lies in particular in the center of the rolling stock, the radius of the virtual circular path section or the position of the virtual center point being adjustable within wide limits, in particular in such a way that the virtual center point M can lie on both sides of the linear drive. As a result, it is possible in particular to place the virtual center point in front of the respective linear drive in the transport direction, as shown in FIGS. 7*a* and 7*b*, and the rolling stock can be guided through the rolling line in opposite transport directions, i.e. in reversing operation.

The basic structure of a linear drive shown in FIG. 8 corresponds essentially to the structure of the linear drive shown in FIG. 5. The only difference is that the circulating chains 11, 12, which in the drives shown in FIG. 5 have contact elements contacting the rolling stock, are here equipped with magnets or electric coils 71, 72 so that the rolling stock can be transported between the circulating chains without contact.

| List of reference numerals |
|---|
| 1 Roll |
| 2 Roll |
| 3 Roll stand |
| 4 Linear drive |
| 5 Linear drive |
| 6 Measuring device |
| 7 Measuring device |
| 8 Metal strip |
| 9 Coiler |
| 11 Circulating chain |
| 12 Circulating chain |
| 12a Chain rail |
| 13 Circulating chain |
| 14 Circulating chain |
| 14a Chain rail |
| 15 Servomotor |
| 16 Servomotor |
| 17 Servomotor |
| 18 Servomotor |
| 21 Drive shaft |
| 22 Drive shaft |
| 23 Drive shaft |
| 24 Drive shaft |
| 25 Gear wheel |
| 26 Gear wheel |
| 27 Contact element |
| 28 Contact element |
| 31 Force measuring bearing |
| 32 Force measuring bearing |
| 35 Magnet or electric coil |
| 36 Magnet or electric coil |
| 41 Fixed frame |
| 42 Post |
| 43 Post |
| 44 Rotary column |
| 45 Rotary column |
| 46 Outer wall |
| 47 Guide |
| 48 Actuator |
| 49 Actuator |
| 51 Upper cross member |
| 52 Lower cross member |
| 53 Guide pillar |
| 54 Guide pillar |
| 55 Hydraulic cylinder |
| 56 Hydraulic cylinder |
| 57 Sliding bearing |
| 58 Sliding bearing |
| 59 actuator cylinder |
| 61 Support roll |
| 62 Support roll |
| 63 Support roll |
| 64 Support roll |
| 71 Magnet or electric coil |
| 72 Magnet or electric coil |

The invention claimed is:

1. Device for rolling of rolling stock, the device comprising:

at least one pair of rolls;

a linear drive comprising at least one of a downstream linear drive which is arranged downstream of the at least one pair of rolls in a rolling direction and an upstream linear drive which is arranged upstream of the at least one pair of rolls in a rolling direction, wherein the linear drive is configured to apply tensile stress in the rolling direction to the rolling stock through the at least one pair of rolls;

a tensile stress detector; and a controller configured to receive a detected tensile stress in the rolling direction from the tensile stress detector;

wherein the controller is configured to control the drive power of the linear drive at least in part as a function of the tensile stress in the rolling direction detected by the tensile stress detector, and wherein the controller is configured to either (1) vary the magnitude of the tensile stress in the rolling direction applied to the rolling stock and/or (2) to keep the magnitude of the tensile stress constant behind a roll gap.

2. Device according to claim 1, wherein the controller is configured to determine and/or adjust a torque acting in the linear drive.

3. Device according to claim 1, comprising force measuring bearings in the linear drive and/or the pair of rolls for determining the tensile stress applied to the rolling stock.

4. Device according to claim 3, wherein force measurement bearings are provided in bearing of the drive shafts of the linear drive.

5. Device according to claim 1, wherein the tensile stress detector and/or the controller are configured to measure a tensile stress distribution over a width of the rolling stock.

6. Device according to claim 1, wherein the controller is configured for adjusting the contact pressure of the at least one pair of rolls.

7. Device according to claim 1, wherein the linear drive has at least one adjusting device by means of which the position of the linear drive relative to the rolling stock can be varied during operation.

8. Device according to claim 7, wherein one or both of the downstream linear drive and upstream linear drive comprises an upper and a lower drive which act on the rolling stock from above and below, respectively, and which are held in a fixed frame, and the upper and lower drives can be positioned within the fixed frame relative to the fixed frame.

9. Device according to claim 8, wherein the at least one adjusting device comprises at least one first adjusting device for the upper and lower drive provided on one side of the rolling stock, by means of which the upper and lower drive can be displaced in a direction transverse to the drive direction, and at least one second adjusting device for the upper and lower drive is provided on the opposite side of the rolling stock, by means of which the upper and lower drive can be pivoted about a substantially vertical axis.

10. Device according to claim 7, wherein the adjusting device is designed to enable the linear drive to be pivoted by at least +/−10°.

11. Device according to claim 1, wherein the downstream linear drive comprises an upper drive and a lower drive, and wherein the upper drive and the lower drive of the downstream linear drive have a plurality of contact elements arranged one behind the other in the rolling direction for contacting the rolling stock.

12. Device according to claim 1, wherein the downstream linear drive comprises one or more non-contact eddy current drives which drive or brake the rolling stock without contact.

13. Device according to claim 1, comprising at least one measuring device downstream of the at least one pair of rolls in the rolling direction for measuring the thickness and/or the speed of the rolling stock.

14. Device according to claim 1, comprising both a downstream linear drive which is arranged downstream of the at least one pair of rolls in a rolling direction and an upstream linear drive upstream of the at least one pair of rolls in the rolling direction.

15. Method for rolling a rolling stock, the method comprising:

rolling the stock through at least one pair of rolls;

applying a tensile stress in a rolling direction to the rolling stock by at least a downstream linear drive arranged downstream of the at least one pair of rolls in the rolling direction in cooperation with the at least one pair of rolls and/or an upstream linear drive arranged upstream of the at least one pair of rolls in the rolling direction;

detecting the tensile stress in the rolling direction exerted on the rolling stock by the downstream linear drive and/or the upstream linear drive;

based at least in part on the detected tensile stress in the rolling direction, controlling the tensile stress exerted on the rolling stock to either (1) vary the tensile stress in the rolling direction applied to the rolling stock and/or (2) to keep the tensile stress constant behind a roll gap.

16. Method according to claim 15, comprising changing the height of the roll gap during rolling.

17. Method according to claim 16, comprising changing a direction of the tensile stress exerted by the linear drive on the rolling stock in a controlled manner relative to a longitudinal direction of the rolling stock in order to straighten the rolling stock or to minimize or avoid a saber error.

18. Method according to claim 17, comprising passing the rolling stock through the at least one pair of rolls alternately in opposite directions.

19. The method according to claim 18, comprising controlling the tensile stress in the rolling direction such that it causes at least 50% of the deformation of the rolling stock in the roll gap.

* * * * *